US008289151B2

(12) United States Patent
Koennecke et al.

(10) Patent No.: US 8,289,151 B2
(45) Date of Patent: Oct. 16, 2012

(54) WIRELESS ITEM LOCATOR DOORBELL

(76) Inventors: Weston S. Koennecke, Oak Park, IL (US); Craig A. Zimmerman, Chicago, IL (US); Terry M. Jun, Chicago, IL (US)

( * ) Notice: Subject to any disclaimer, the term of this patent is extended or adjusted under 35 U.S.C. 154(b) by 212 days.

(21) Appl. No.: 12/608,994

(22) Filed: Oct. 29, 2009

(65) Prior Publication Data

US 2010/0045456 A1 Feb. 25, 2010

(51) Int. Cl.
*G08B 1/08* (2006.01)

(52) U.S. Cl. ..... 340/539.1; 340/506; 340/3.1; 340/328

(58) Field of Classification Search ..... 340/506, 340/13.1, 328, 330, 531
See application file for complete search history.

(56) References Cited

U.S. PATENT DOCUMENTS

| | | | | |
|---|---|---|---|---|
| 6,114,948 | A * | 9/2000 | Astell | 340/332 |
| 6,897,765 | B2 * | 5/2005 | Kaje | 340/321 |
| 7,015,943 | B2 * | 3/2006 | Chiang | 348/143 |
| 7,746,223 | B2 * | 6/2010 | Howarter et al. | 340/506 |
| 2006/0139449 | A1 * | 6/2006 | Cheng et al. | 348/61 |
| 2008/0129498 | A1 * | 6/2008 | Howarter et al. | 340/541 |
| 2008/0129821 | A1 * | 6/2008 | Howarter et al. | 348/143 |

* cited by examiner

*Primary Examiner* — Daryl Pope
(74) *Attorney, Agent, or Firm* — Katherine J. Kim

(57) ABSTRACT

The present invention relates to a wireless item locator doorbell system comprising a doorbell unit and a moveable item locator unit in communication with said doorbell unit wherein said doorbell unit further comprises a motion sensor configured to actuate a message device, wherein said message device is configured to provide a message upon activation of said motion sensor, an actuating mechanism in communication with said motion sensor and/or message device, a transmitter configured to deliver a wireless signal upon actuation of said actuating mechanism, wherein said moveable item locator unit further comprises a receiver configured to receive signals from said transmitter of said doorbell unit, and a second message device configured to provide a message upon activation by said receiver.

14 Claims, 10 Drawing Sheets

FIG. 5
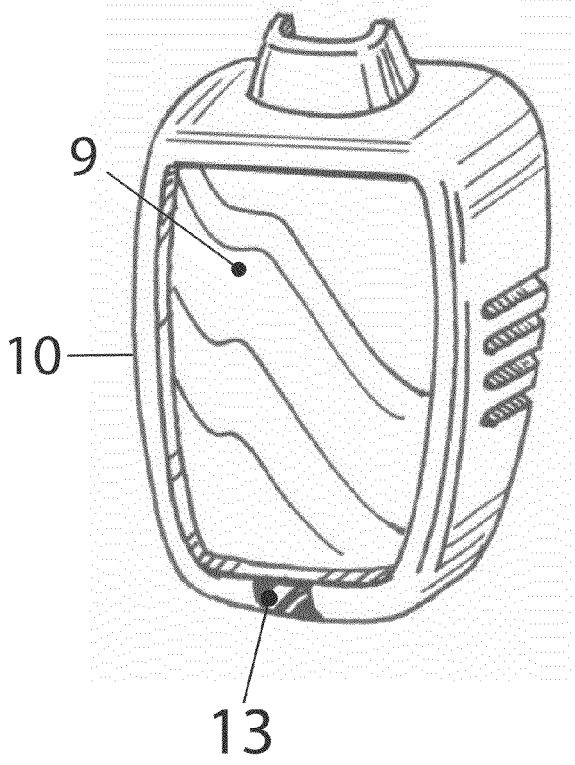
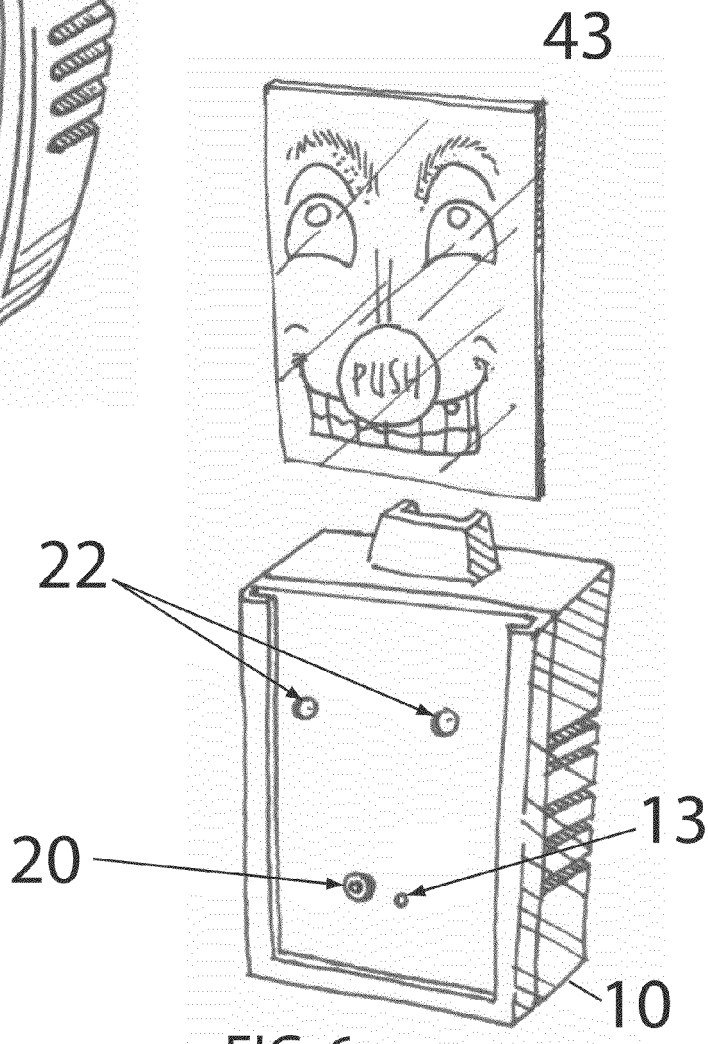
FIG. 6

FIG. 8
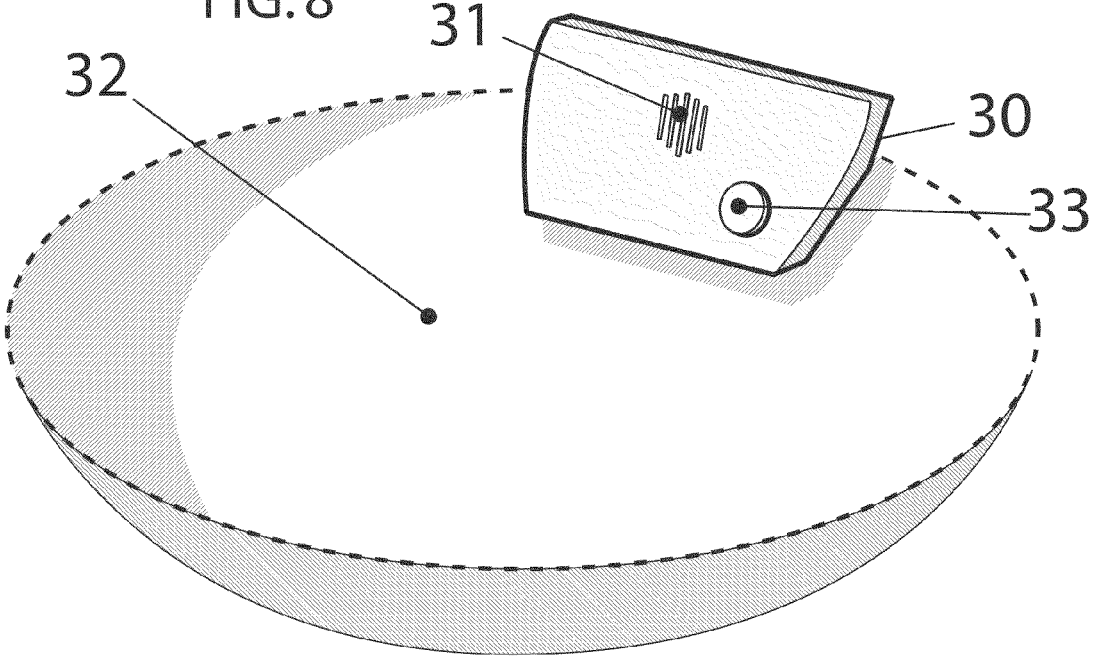
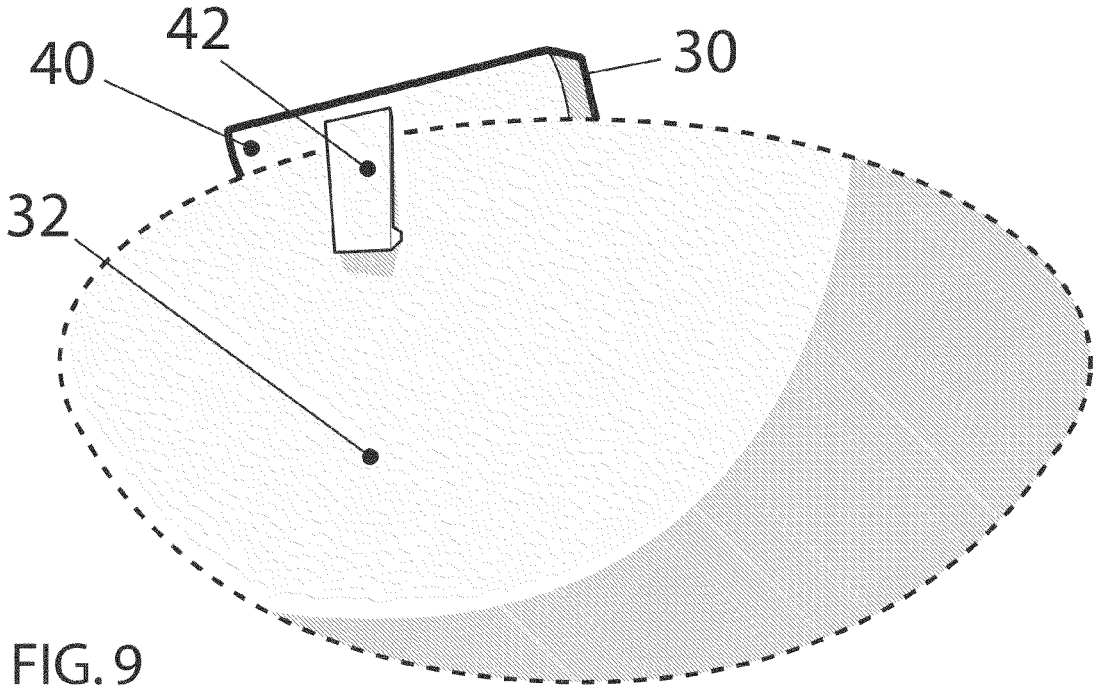
FIG. 9

(Doorbell Modes and Transitions)

(Instructional Sequence)

(Button Press Sequence)

(Receiver Sequence)

WIRELESS ITEM LOCATOR DOORBELL

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING

Not Applicable

BACKGROUND

Doorbells traditionally announce the arrival of a visitor. Often times, the visitor is arriving to pick a specific object up. The resident while waiting for the visitor may walk around with the object in hand and then may accidentally misplace it and thus could take time to reach the door because the desired item cannot be found. If singing carolers or trick-or-treaters, for example, arrive at a home, and the resident in anticipation has the treat bowl in hand but then puts the bowl down to answer the phone or tend to other matters and then cannot find the treat bowl in time, the visitors may leave. Another example is if a resident is waiting for the delivery of food or a package and needs to pay the visitor in cash or a check, they may spend too much time looking for their wallet or checkbook while the delivery visitor waits at the door. Another example is an office setting where, for example, there is a conference room full of documents and boxes and the employee has the latest draft in hand. The employee may put the document down and it may get lost in a sea of boxes of documents. When an executive arrives at the entrance of the conference room demanding the latest draft of a document, the employee may spend too much time looking for the desired document. There is a need for a system where upon the arrival of a visitor, a resident can efficiently find a desired object that is misplaced and greet the visitor with the object in hand.

Furthermore, if the resident is not home when the visitor arrives, there are limited options for leaving items such as keys, documents or a check, for a visitor. Larger buildings tend to have a concierge allowing the resident to leave items with the concierge for easy pick up. There is a need for a device that allows residents of homes and smaller buildings to leave items meant for visitors that can be found by visitors in an efficient manner upon arrival.

There are doorbells which comprise a fixed transmitter and a fixed receiver and monitor the arrival of visitors. The monitor station also comprises a means to communicate with the visitor. Such systems have standard receivers; anything from wall mounted to animated character units, that are meant to remain stationary. Their primary task is to make an audible, and sometimes visual cue to the occupant that someone is at the door. These receivers are passive. These systems do not allow residents to walk around with the receiver that is coupled to an object as the receivers are not designed to be moveable.

There are doorbells that allow residents to leave prerecorded messages for visitors and also allow visitors to leave recorded messages. These doorbells do not assist residents in finding items meant to be given to visitors, nor allow residents to leave items for visitors when they are not home.

Another disadvantage of traditional doorbells is when younger, shorter visitors arrive on festive occasions such as holidays or birthday parties they cannot locate or reach the traditional doorbell. Thus, there is a need for a doorbell that is interactive so that younger visitors can be entertained and also locate the doorbell. There is a further need for a doorbell that can be installed at various heights and also be decorative to enhance the mood of the festivities. Moreover, when residents decorate the front of their homes for a party or holiday, they usually purchase new decorations for each holiday. Thus, there is a need for a decorative doorbell that can be used all year round for different festive occasions so that the resident would not have to buy a different decorative doorbell for each occasion.

There are item locating devices comprising a transmitter and a plurality of receivers. These item locators do not have a fixed transmitter and thus the transmitter can be misplaced as well. These devices also do not provide a simple way of attaching and removing the receivers multiple times to and from an object. Thus there is a need for a system where the transmitter will not be misplaced and also where the receiver can be switched to various objects.

There is nothing in the art that cures all of these deficiencies and provides a user a simple way of locating an object in an efficient manner upon the arrival of a visitor.

SUMMARY

The present invention relates to a wireless item locator doorbell system comprising a doorbell unit and a moveable item locator unit in communication with said doorbell unit wherein said doorbell unit further comprises a motion sensor configured to actuate a message device, wherein said message device is configured to provide a visual and/or auditory message upon activation of said motion sensor, an actuating mechanism in communication with said motion sensor and/or message device, a transmitter configured to deliver a wireless signal upon actuation of said actuating mechanism, wherein said moveable item locator unit further comprises a receiver configured to receive signals from said transmitter of said doorbell unit, and a second message device configured to provide a message upon activation by said receiver.

BRIEF DESCRIPTION OF THE DRAWINGS

FIG. 5 illustrates another set of embodiments of the invention where the doorbell unit comprises a monitor which displays a visual and/or auditory message.

FIG. 6 illustrates another set of embodiments of the invention where the faceplate can slide into the doorbell unit.

FIG. 8 illustrates a perspective view of the moveable item locator unit removeably attached to a treat bowl.

FIG. 9 illustrates the back view of the moveable item locator unit is clipped onto a treat bowl.

DESCRIPTION

The present invention relates to a wireless item locator doorbell system comprising a doorbell unit and a moveable item locator unit in communication with said doorbell unit wherein said doorbell unit further comprises a motion sensor configured to actuate a message device, wherein said message device is configured to provide a message upon activation of said motion sensor, an actuating mechanism in communication with said motion sensor and/or message device, a transmitter configured to deliver a wireless signal upon actuation of said actuating mechanism, wherein said moveable item locator unit further comprises a receiver configured to receive signals from said transmitter of said doorbell unit, and a second message device configured to provide a visual and/or auditory message upon activation by said receiver.

The message device can be any suitable means for storing and/or producing a message such as for example a sound device, voice recorder or a video recorder. The message device can produce sound by any suitable means such as via a digital sound chip, playback of magnetic compact cassette, playback of optical compact disc (CD), or by mechanical means including flat "records" or "record" cylinders. The message device can produce any suitable message for interactive or informative communication such as a visual, auditory or vibratory message or any combination thereof.

Specifically, it relates to a system where when a visitor's presence is detected, a sequence follows that leads to the finding of an object. Furthermore, the doorbell unit can be placed at alternate heights, including child appropriate heights, over a door handle, or placed anywhere near a doorway, and where the receiver can be placed on any object.

The purpose of this invention focuses on the experience of both the occupant and potential guests. Past systems have focused on specific goals including security of occupant, entertainment of the occupant, real-time storage of verbal information from guests, or entertainment of the guest.

The present invention is interactive, that is certain sequences must be actuated by a person. There are times when visitors may pass by and activate the motion sensor but have no intention of actuating the doorbell. In the present invention, a person who approaches the wireless item locator doorbell, can decide after viewing or listening to the prerecorded messages, whether or not to actuate the doorbell and subsequent sequences.

The transmitter is designed to, through the use of audible commands and attention getting lights, instruct and educate potential guests on use and distinguish it from the everyday doorbell.

Figure 1:
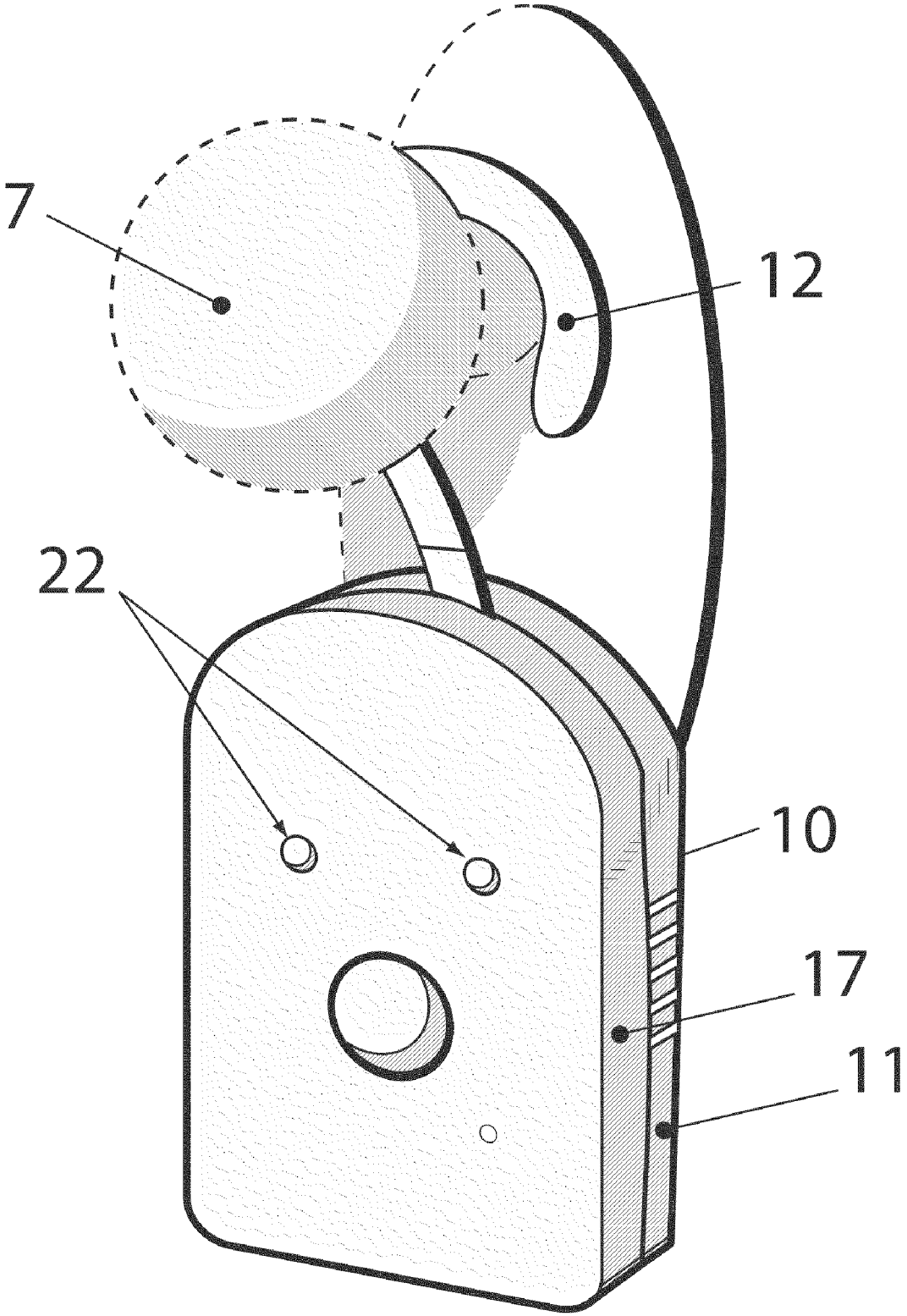
FIG. 1 is a perspective view of a doorbell unit of a set of embodiments of the invention.

FIG. 1 illustrates one embodiment of the invention. The wireless item locator doorbell unit 10 may be hooked over a door handle 7 with hanger 12 or may be a standalone device (not shown). The doorbell unit 10 has a removeably attached unit cover 17. The doorbell unit 10 contains a housing 11 which comprises a motion sensor (shown in FIG. 2), a message device (shown in FIG. 2) and a wireless transmitter (shown in FIG. 2).

Figure 2:
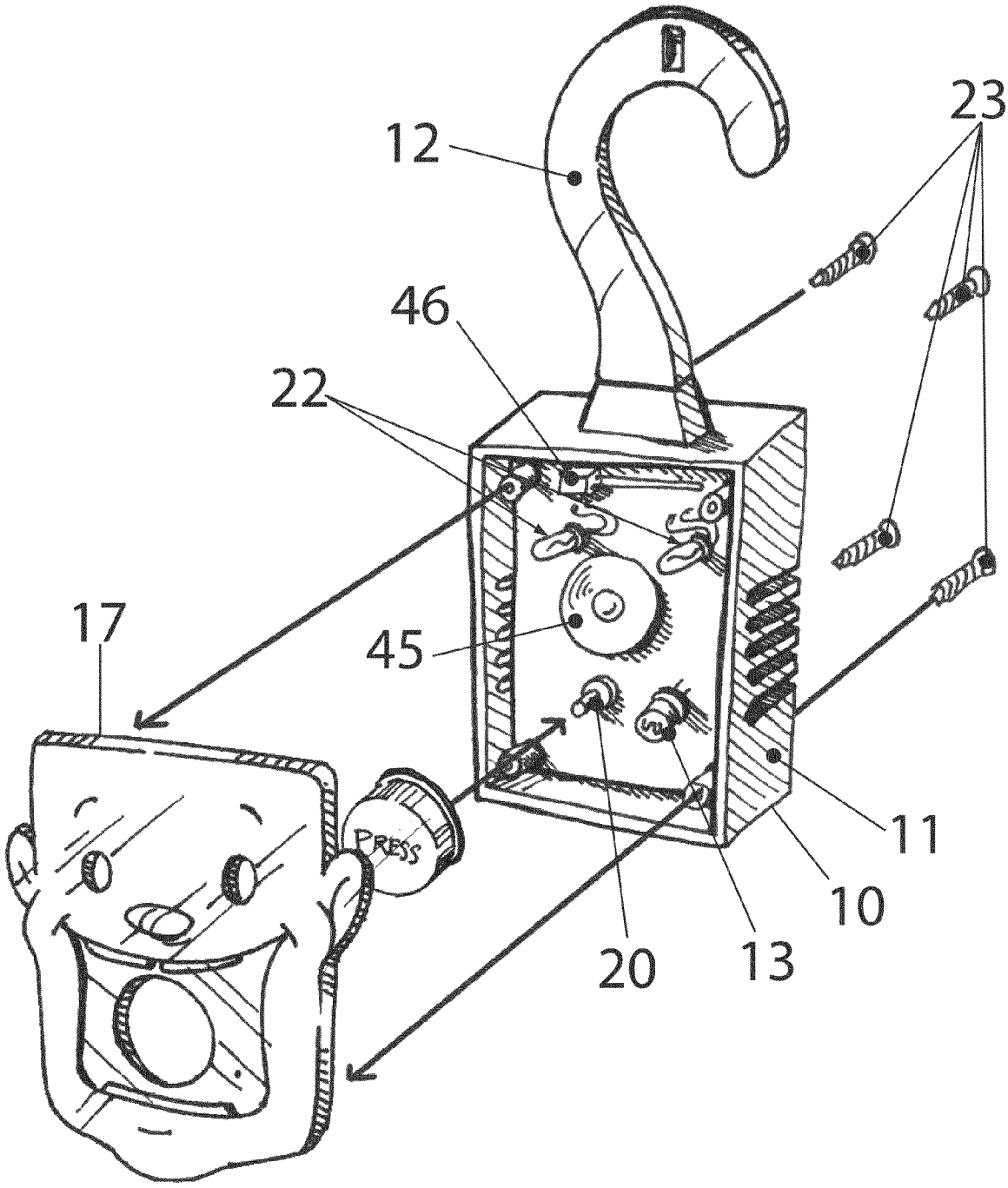
FIG. 2 is a perspective view of a doorbell unit of another set of embodiments of the invention.

FIG. 2 illustrates another embodiment of the invention wherein the doorbell unit 10 has a removeably attached unit cover 17 which is decorative or resembles a character and is configured to cover the circuit board which comprises components within the housing 11 of the doorbell unit 10. Any suitable fastening element can be used to secure the faceplate to the doorbell unit 10 such as screws 23, a snap, interlocking grooves, for example. The decorative unit cover 17 has an open space to accept a button 20 cover which is on the circuit board, when the faceplate is attached. The decorative unit cover 17 also has openings to accept the light sources 22 which are on the circuit board when attached. The circuit board is within the housing 11. The doorbell unit 10 can be hooked over an object with hanger 12 and/or any means for mounting or securing said doorbell unit 10. Any suitable means for mounting or securing can be used such as mounting brackets, an adhesive plate, or a Velcro® set, for example.

There is a motion sensor 13, sound device 45 and wireless transmitter 46 which are connected to an electronic circuit board within said housing 11. The doorbell unit housing 11 can be made of any suitable material such as plastic, metal, or wood. When the motion sensor 13 is activated, it actuates a message device to produce an instructional pre-recorded message. The message device further comprises a sound device 45 which can produce sound by any suitable means such as via a digital sound chip, playback of magnetic compact cassette, playback of optical compact disc (CD), or by mechanical means including flat "records" or "record" cylinders. The message could be a standard salutation or a holiday greeting that can either be recorded by professional actors and included with the purchase of the doorbell or recorded by the resident. The message could also include instructions, the most typical message instructing the visitor to actuate a light source 22 by pressing a button 20 for example that acts as the doorbell. The button 20 could also have a light source within it. The light source can be any suitable source such as a light emitting diode (LED), organic light emitting diode (OLED), passive or active matrix liquid crystal displays, electroluminescent lighting (EL), or other preferably non-heating low power electric lighting sources.

Figure 3:
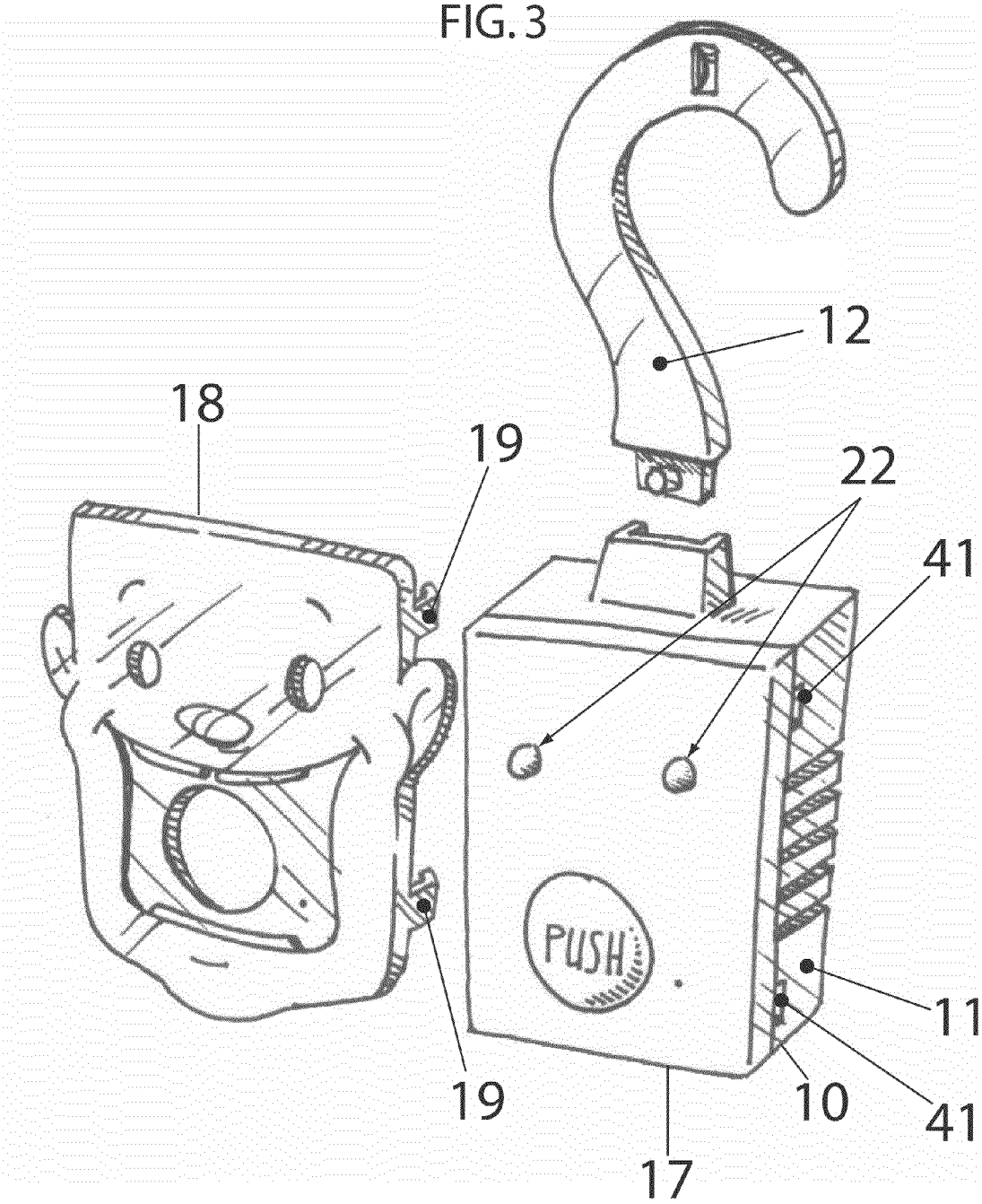
FIG. 3 is a perspective view of a doorbell unit of another set of embodiments of the invention.

FIG. 3 illustrates another embodiment of the invention where there is a removeably attached unit cover 17 on a part of the housing 11 configured to cover the components of the circuit board described in FIG. 2. In another embodiment, the unit cover 17 can be integral with the housing 11. There is a removeably attached faceplate 18 where any suitable means may be used as the fastener element such as the clips 19 which are received by the openings 41. The decorative faceplate 18 has an open space to accept the button 20 cover which is on the circuit board, when the faceplate 18 is attached to the housing 11. The decorative faceplate 18 also has openings to accept the light sources 22 which are on the circuit board when attached. The circuit board is within the housing 11. In addition to the light sources 22, a prerecorded message is activated and heard through the sound device. The doorbell unit 10 can be mounted by hook 12 by simply hanging over a doorknob or with any suitable means for hanging such as a fabric loop for hanging on doorknob, or a string to hang on doorknob, or a hoop to hang on doorknob, or a hook to hang over doorknob with unit suspended below, or a full cover for the doorknob. The doorbell unit 10 can also be freestanding in a statue or figurine or on a table (not shown).

Figure 4:
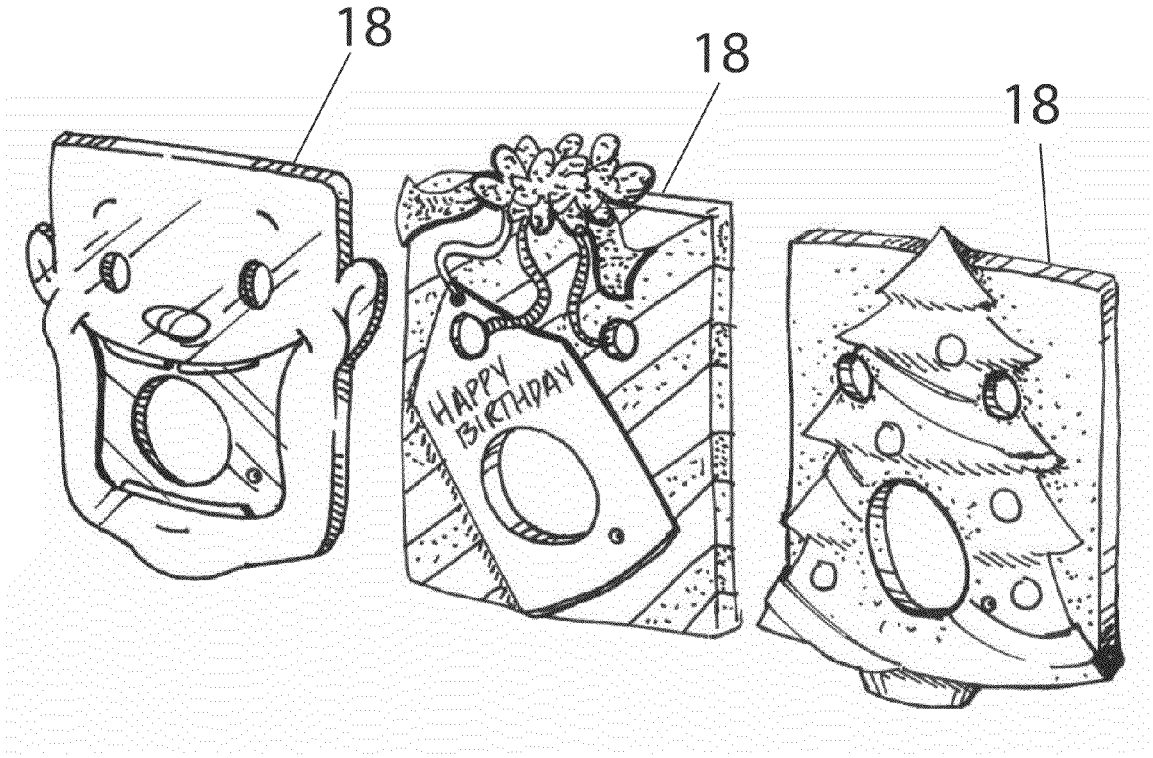
FIG. 4 illustrates different decorative faceplates which are removeably attached to the doorbell unit.

FIG. 4 illustrates another embodiment where different types of decorative or thematic faceplates 18 are removeably attached to the doorbell unit 10. The faceplates 18 are interchangeable. This way the resident can choose the faceplate 18 based on the theme of the party or the holiday. Such decorative faceplates 18 could include a character, or a birthday motif or a Christmas motif. Any suitable character or holiday may be portrayed, such as halloween characters such as a pumpkin, ghost, witch or Christmas characters such as a snowman, a Santa, or a reindeer. Other characters could be for Easter, St. Patrick's Day, Thanksgiving, or a licensed animation or fairytale character or a completely new character. Other themes could include birthdays, religious holidays, anniversaries, graduations, congratulations, New Year's, specific types of parties such as garden parties, to name a few. The faceplates 18 could be removeably fixed onto the doorbell unit 10 or can easily be interchangeable with other decorative faceplates 18. In another embodiment, the faceplate 18 and the doorbell unit 10 can be integral.

In another embodiment of the invention, the faceplates 18 comprise a means for storing a prerecorded message such as a soundchip or a recorder. The faceplate 18 can be attached to the doorbell unit 10 by a snap, a fastening element, or interlocking grooves, for example. In yet another embodiment of the invention, the faceplate has an LED behind a button that acts as a doorbell. In this embodiment, the decorative faceplate is connected to the doorbell unit by some sort of circuit so that when the doorbell is actuated, it will activate the transmitter which will send a wireless signal to the mobile item locator receiver.

FIG. 5 illustrates another embodiment wherein the doorbell unit 10 comprises a monitor unit 9, a motion sensor 13 and a wireless transmitter (not shown). The monitor unit 9, motion sensor 13 and wireless transmitter are connected by circuits that are within the doorbell unit 10. The monitor unit 9 further comprises a sound device. Said monitor unit 9 is configured to play prerecorded music and/or sound effects and/or display a visual and/or auditory message. The sound can be produced by any suitable means such as via a digital sound chip, playback of magnetic compact cassette, playback of optical compact disc (CD), or by mechanical means including flat "records" or "record" cylinders. There is an output speaker in the doorbell unit 10. The monitor unit 9 can be configured to store images of various digital faceplates, such as those illustrated in FIG. 4, which can be selected for visual display by the user.

FIG. 6 illustrates another embodiment where the decorative faceplate 43 is a cardboard insert and is configured to slide into grooves 44 on doorbell unit 10. The doorbell unit 10 comprises a light source 22, a button 20, a motion sensor 13 and a wireless transmitter (shown in FIG. 1). The light source 22, button 20, motion sensor 13 and wireless transmitter are all connected to a circuit board within the doorbell unit 10.

Figure 7:
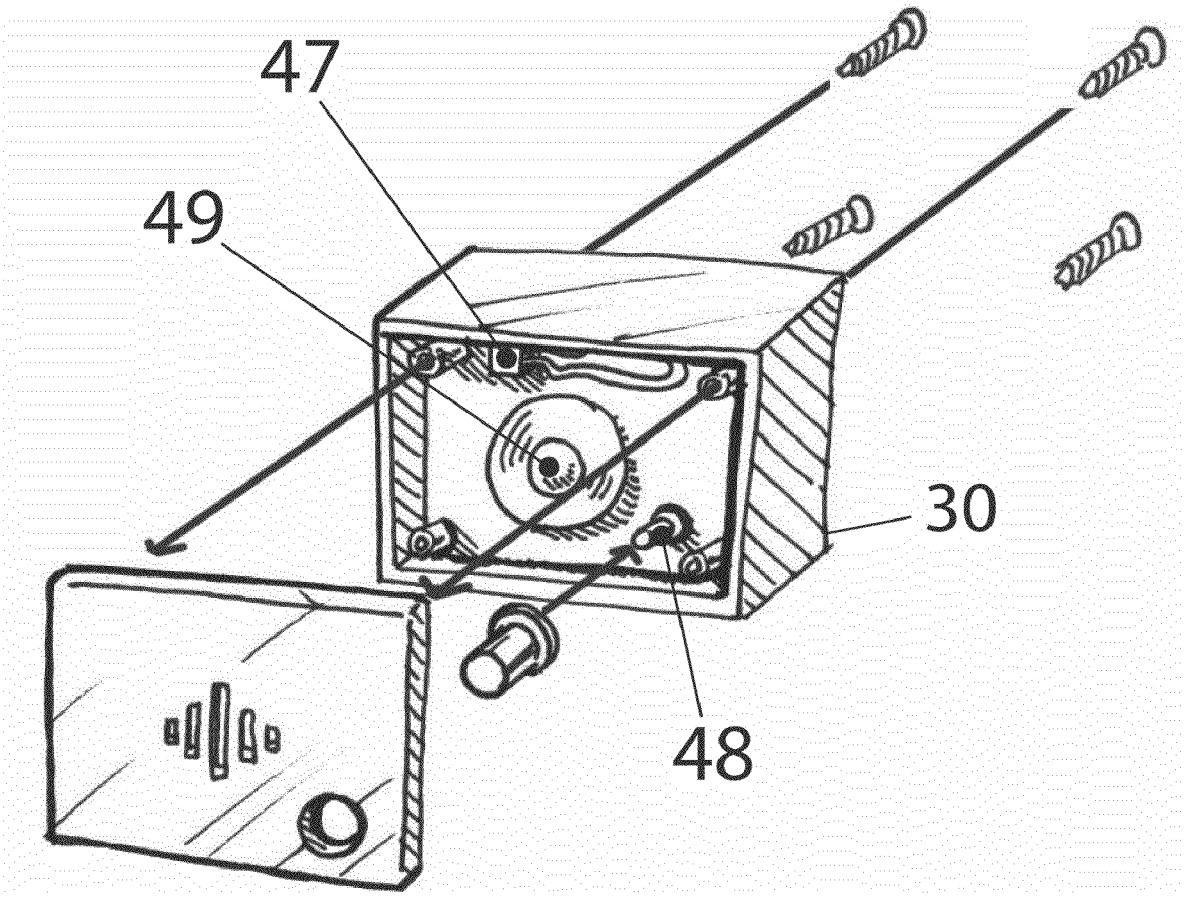
FIG. 7 illustrates a perspective view of the moveable item locator unit.
Figure 10:
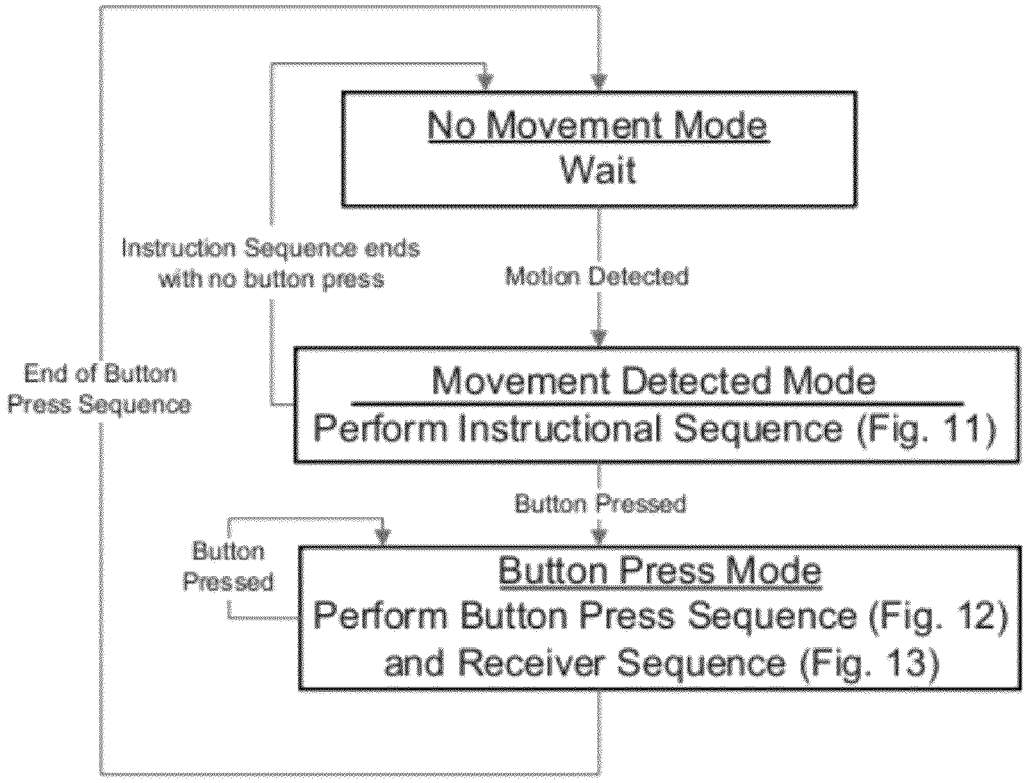
FIG. 10 illustrates a flow chart of the doorbell modes and transitions of a set of embodiments of the invention.
Figure 11:
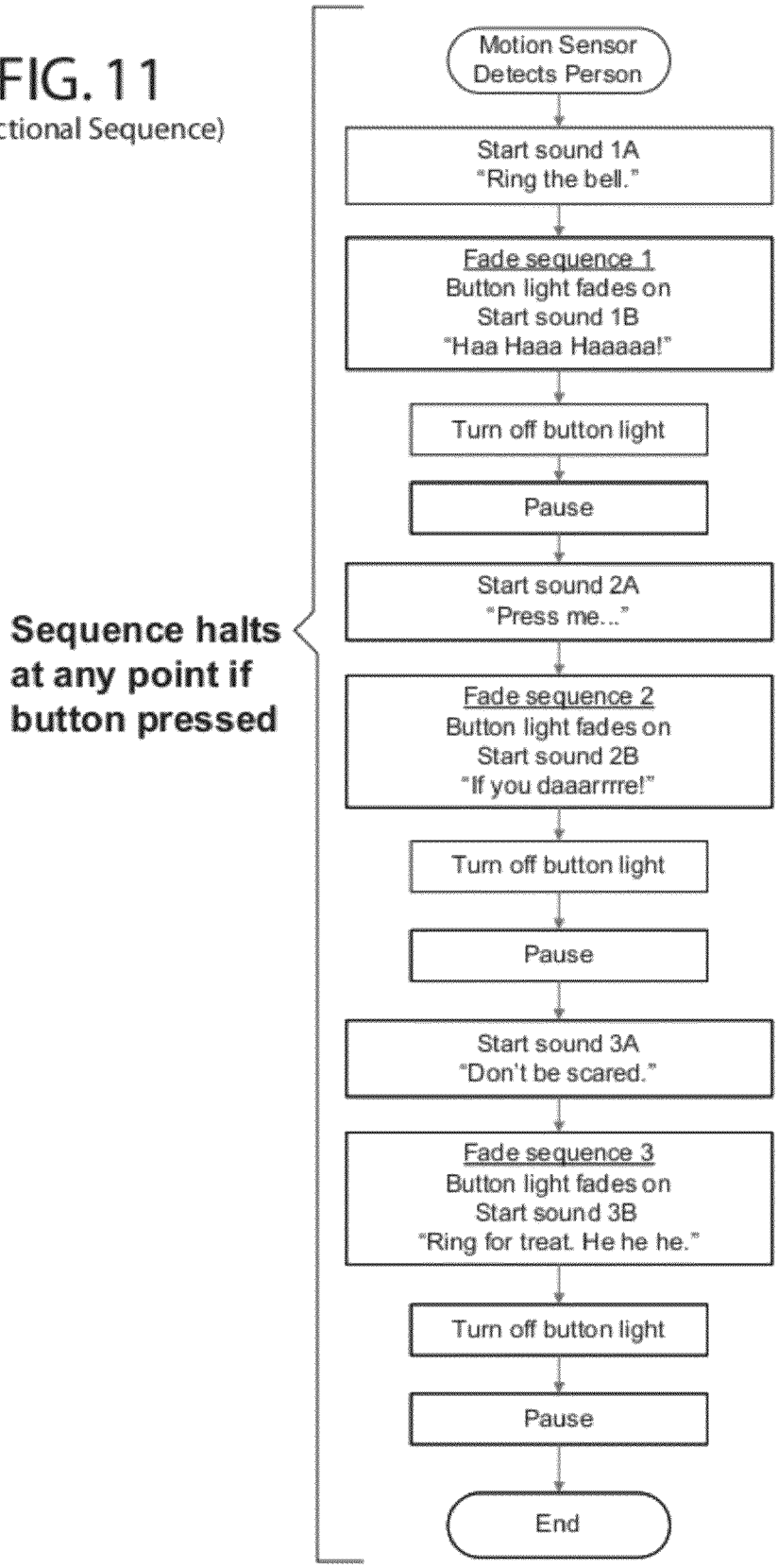
FIG. 11 illustrates a flow chart of the Instructional Sequence that follows once motion is detected.
Figure 12:
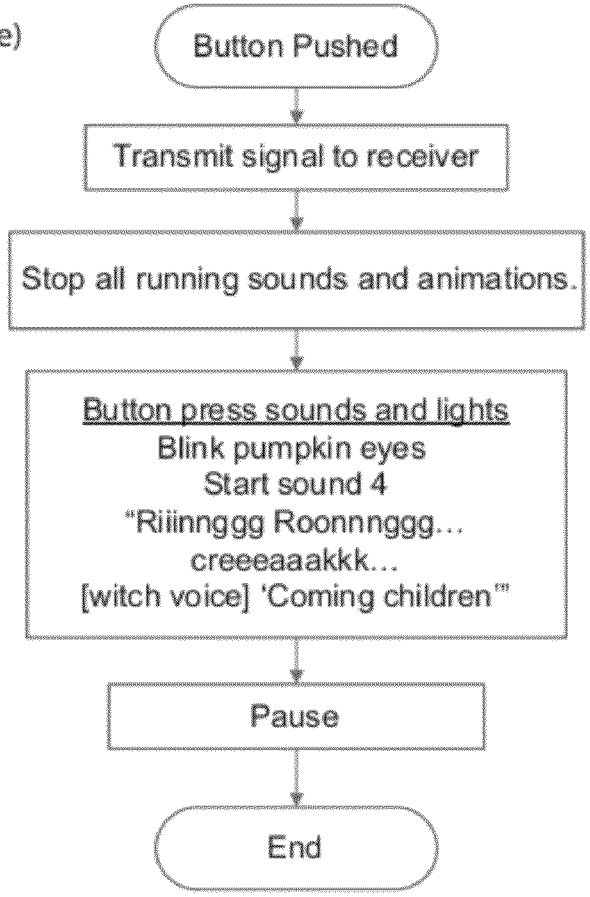
FIG. 12 illustrates a flow chart of the Button Press Sequence which follows once the doorbell is actuated.
Figure 13:
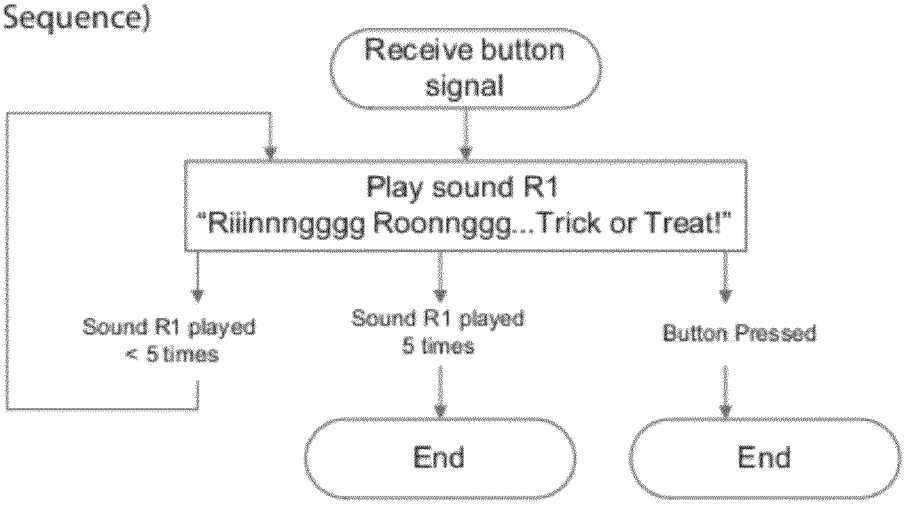
FIG. 13 illustrates a flow chart of the Receiver Sequence which follows once the transmitter sends a wireless signal to the receiver.

FIG. 7 illustrates the moveable item locator unit 30 which comprises a circuit board which comprises a receiver 47, button 48 and sound device 49. There is a removeably attached unit cover over the circuit board and all of the components. The unit cover has an opening to receive the button 48 cover. The unit cover can be attached to the housing of the moveable item locator 30 by any suitable means such as screws (shown). The unit cover can also be integral with the housing.

FIG. 8 illustrates another embodiment of the invention wherein the moveable item locator unit 30 which can be attached to an object such as a treat bowl 32 with a fastening element (shown in FIG. 9). Any suitable fastening element can be used such as snaps, interlocking grooves, a clip, a strap, or a string for example. The moveable item locator unit 30 contains a housing which comprises a receiver and a sound device 31 which are both connected to a circuit within the housing. In another embodiment, the resident attaches the moveable item locator unit 30 to the item that the resident will want to have in hand to greet the visitor. Once the visitor arrives, the motion sensor will be triggered and any suitable visual and/or auditory message will be produced such as a greeting or salutation or instructions to ring the doorbell button 20. Once the visitor rings the doorbell button 20 on the doorbell unit 10, a wireless signal is transmitted to the moveable item locator unit 30. In another embodiment, the visitor is instructed to punch in a code onto a keypad (not shown) on the doorbell unit 10. When the signal is received, any suitable auditory and/or visual message such as a sound effect or music, is produced, thereby enabling the resident to locate the object. Once the item is located, the resident can easily turn the message off by any suitable actuating mechanism such as a button 33 and greet the visitor with the item in hand. By using a looped sound or an alert with a time-out, the moveable item locator unit 30 is attached to a treat bowl and free to be moved around the house but still be quickly located when activated by the transmitter and the repeating sound stopped by occupant upon such locating.

FIG. 9 illustrates another embodiment where the back side 40 of the mobile item locator unit 30 comprises a means to attach the moveable item locator unit 30 to a treat bowl 32. Any suitable means for fastening said moveable item locator unit 30 to said treat bowl 32 may be used such as a clip 42.

In yet another embodiment of the invention, the doorbell unit 10 has another purpose aside from locating an item and that is to entertain children visitors. The decorative faceplates 18 can be characters that children will respond to and the prerecorded messages could be geared towards interacting with children visitors. One example is Halloween. When the children visitors approach the main entrance, the motion sensor on the doorbell unit will be actuated and a prerecorded message can greet the children and send instructions about ringing the doorbell. In another embodiment, instructions could ask children visitors if they want tricks or treats or instructing them to make goblin sounds. In this embodiment, the sequence could be actuated by sound and the children responding loudly could activate a second message that instructs them to ring the doorbell if they want treats. Once the doorbell is actuated, another message could inform them that treats are on the way. Another variation on this embodiment could be for a themed birthday party for example. The message could be a character clown voice speaking or a theme character's voice asking the children visitors if they are ready to have fun or ready to play birthday games. Once the children respond, another message could instruct them to ring the doorbell actuating the light sources 22 on the doorbell unit 10. Once the doorbell is actuated, a wireless signal is transmitted to the moveable item locator unit 30 which may be on a candy bowl which the resident may desire to have in hand to greet the children. Or if the resident is dressing up as a clown but does not desire to wear the wig or mask continuously but only to greet children at the door, the moveable item locator unit 30 could be attached to the wig or mask so that when the children ring the doorbell, the resident can easily locate the wig or mask and have it on when greeting the children at the door.

The moveable item locator unit 30 can be made of any suitable material such as plastic, metal or wood. The moveable item locator unit 30 further comprises an output speaker and a means for recording and playing a prerecorded visual and/or auditory message. The moveable item locator unit 30 can be attached to an object with a fastening element such as a clip, or an adhesive, or a Velcro® unit, or a strap, or a magnet set, or be designed to fit a specific, complimentary bowl through various attachment means. The moveable item locator unit 30 can be placed on any object and placed where it can still receive a signal from the wireless transmitter of the doorbell unit 10. The resident places the moveable item locator unit 30 with the object or attaches it to the object that will be needed once a visitor arrives. In another embodiment, the receiver 32 could be integrated with a treat bowl. Once the button 20 on the doorbell unit 10 is actuated, a wireless signal is transmitted to the moveable item locator unit 30. Once the receiver 32 is activated, a recording of a sound or a message is played until it is manually deactivated. If the receiver 32 is in the home, this enables the resident to locate the item searched immediately and then answer the door with the item in hand. If the receiver is placed outside of the home, the visitor can locate the item which may be out of plain view. Once the receiver is located, it can be switched off in a simple manner.

In another embodiment of the invention, moveable item locator unit can be on any suitable means for holding documents together such as a binder clip or a folder or a document box. In this embodiment, the doorbell unit can be mounted or placed at the doorway of a conference room. Someone can approach the conference room and actuate the doorbell which will actuate the moveable item locator unit and the person in the conference room can immediately locate the desired set of documents and open the door with the item in hand.

Provided is also a kit comprising parts in a package said parts comprising a doorbell unit and a moveable item locator unit. The doorbell unit further comprises a motion sensor, a sound device, and a wireless transmitter. The doorbell unit also comprises a removeably attached faceplate. The moveable item locator unit further comprises a wireless signal receiver.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

What is claimed is:

1. A wireless item locator doorbell system comprising:
a doorbell unit; and
a moveable item locator unit in communication with said doorbell unit;
wherein said doorbell unit further comprises:
a motion sensor and a message device, the motion sensor configured to actuate the message device upon detection of an individual by the motion sensor;
wherein said message device is configured to provide a message to the detected individual upon activation of said motion sensor;
an actuating mechanism in communication with said motion sensor and/or message device;
a transmitter configured to deliver a wireless signal upon actuation of said actuating mechanism;
wherein said moveable item locator unit further comprises:
a receiver configured to receive signals from said transmitter of said doorbell unit;
a second message device configured to provide a message upon activation by said receiver.

2. The wireless item locator doorbell system according to claim 1, further comprising a removeably attached faceplate.

3. The wireless item locator doorbell system according to claim 2, wherein said faceplate comprises a fastener element.

4. The wireless item locator doorbell system according to claim 2, wherein said faceplate further comprises a monitor unit configured to display a visual message.

5. The wireless item locator doorbell system according to claim 1, wherein said doorbell unit further comprises a unit cover.

6. The wireless item locator doorbell system according to claim 1, wherein said message device comprises a sound device.

7. The wireless item locator doorbell system according to claim 1, wherein said message device is configured to provide an auditory, visual and/or vibratory message or any combination thereof.

8. The wireless item locator doorbell system according to claim 1, wherein said second message device comprises a second sound device.

9. The wireless item locator doorbell system according to claim 1, wherein said doorbell unit comprises a mounting member.

10. The wireless item locator doorbell system according to claim 8, wherein said mounting member is a hook.

11. The wireless item locator doorbell system according to claim 1, wherein said doorbell unit further comprises a light source.

12. The wireless item locator doorbell system according to claim 1, wherein said item locator unit further comprises a second actuating mechanism configured to deactivate said second message device.

13. The wireless item locator doorbell system according to claim 1, wherein said item locator unit comprises a fastening element configured to attach said item locator unit to an object.

14. A wireless item locator doorbell system comprising:
a doorbell unit; and
a moveable item locator unit in communication with said doorbell unit;
wherein said doorbell unit further comprises:
means for sensing motion of an individual, the means for sensing configured to actuate means for producing a message for the sensed individual;
wherein said means for producing a message is configured to provide an auditory, visual and/or vibratory message to the sensed individual upon activation of said means for sensing motion;
means for actuating transmitter in communication with means for sensing motion;
means for transmitting a signal to said moveable item locator unit;
wherein said moveable item locator unit further comprises:
means for receiving a signal from said doorbell unit;
means for producing a message;
means for deactivating said visual and/or auditory message.

* * * * *